US005255968A

United States Patent [19]

Craven

[11] Patent Number: 5,255,968

[45] Date of Patent: Oct. 26, 1993

[54] REPLACEABLE SIGN FACE

[75] Inventor: Herman R. Craven, Fresno, Calif.

[73] Assignee: The Vendo Company, Fresno, Calif.

[21] Appl. No.: 627,069

[22] Filed: Dec. 13, 1990

[51] Int. Cl.[5] ..... A47B 81/00

[52] U.S. Cl. ..... 312/234; 40/575; 40/611

[58] Field of Search ..... 40/584, 611, 564, 576, 40/575; 312/234, 234.3, 265.6, 204

[56] References Cited

U.S. PATENT DOCUMENTS

| | | | |
|---|---|---|---|
| 2,624,141 | 1/1953 | Martin | 40/618 X |
| 3,803,738 | 4/1974 | Weiss | 40/611 X |
| 4,320,933 | 3/1982 | Felix et al. | 312/204 X |
| 4,951,406 | 8/1990 | Lemire | 40/576 |
| 4,973,109 | 11/1990 | Diedrich | 312/114 |

FOREIGN PATENT DOCUMENTS

| | | | |
|---|---|---|---|
| 2105896 | 3/1983 | United Kingdom | 40/564 |

*Primary Examiner*—Kenneth J. Dorner
*Assistant Examiner*—Brian K. Green
*Attorney, Agent, or Firm*—Robbins, Berliner & Carson

[57] ABSTRACT

A replaceable sign face used in vending machines for operating instructions, advertising purposes and the like. A front panel having optically transparent regions and a curved surface and constructed from a sturdy, solid material serves as a permanent protective cover to deter attempts at tampering and breaking in for food or money. A replaceable inner panel bearing advertising media is disposed directly behind the front panel. The inner panel is formed from a thin, resilient and inexpensive material which is configured for frequent replacement with minimum effort. The transparent front panel and replaceable inner panel bearing instructional and advertising media (hereinafter sometimes referred to as visual displays) are securely held within retainers disposed at either end of the front face of the vending machine.

8 Claims, 2 Drawing Sheets

REPLACEABLE SIGN FACE

FIELD OF THE INVENTION

The present invention relates generally to the field of vending machines and the like. More specifically, the present invention relates to a replaceable sign face for use in a vending machine.

BACKGROUND OF THE INVENTION

Typical vending machines have operating instructions, advertising media or product identification displayed on the front face. A front panel bearing the advertising media, otherwise referred to as a sign face, is disposed in an opening formed in a front door of the vending machine. The front panel has a generally curved surface with the advertising media silk-screened on its inner surface. The front panel is illuminated from behind by a fluorescent light source disposed proximate its inner surface. In most cases, the front panel is almost as big as the front door.

In order to discourage vandalism or attempts to break in for food or money, the front panel bearing the advertising media or sign face is commonly constructed from a sturdy, transparent, solid material. To this end, a strong and expensive plastic material such as polycarbonate is used.

With such rigid and heavy polycarbonate front panels, during the silk-screening process as otherwise, manual processing and handling is required. In addition, a final white coat to properly diffuse light for proper illumination and color definition is normally required.

Given the bulk and dimensions of such front panels, they are installed in the front doors of vending machines with substantial effort and difficulty during the manufacturing process. Consequently, it is impractical to replace or substitute them at their place of operation.

Moreover, because of the expensive and strong material used, they cannot be frequently replaced. In order to change the advertising media, the front panel would have to be discarded and replaced with a new or different front panel bearing new advertising media. This requires a major rebuilding of the front door. For foreign countries, vending machines are manufactured with front panels bearing sign faces in different languages. In order to replace signs for different languages, the entire door requires rebuilding which has proved to be a significant limitation from a marketing standpoint. Such requirements necessitate maintaining a substantial inventory of complete vending machines with different languages or alternatively, strict production scheduling to assure the correct panel is attached to each vending machine at the time of manufacture. Thus, prior vending machine sign faces do not provide the flexibility or convenience of being able to change them with ease, as and when desired.

In addition, with prior sign faces it is not feasible to feature advertising of special or new products or replace the sign faces every time the inventory of food or drink items dispensed by the vending machine is replenished. Prior front panels provide only a single section which can be replaced only by dismantling the outer door.

Thus, a need exists for an inexpensive replaceable sign face for a vending machine which can be frequently replaced with ease.

SUMMARY OF THE INVENTION

The present invention provides a replaceable sign face for vending machines and the like which is inexpensive and is configured to be frequently replaced with minimum effort. The replaceable sign face is disposed within an opening provided in an outer door of the vending machine. It is securely held within retainers suitably arranged on either side of the opening.

In one aspect of the present invention, the replaceable sign face has a front panel which includes at least some portions which are transparent or which may be entirely transparent and which is constructed from a sturdy, solid material which serves as a permanent protective cover to prevent tampering. The front panel has a suitably curved surface, when assembled.

In another aspect of the present invention, the replaceable sign face has a replaceable inner panel, bearing the visual displays, which is disposed behind the front panel.

In yet another aspect of the present invention, the replaceable inner panel is formed from a suitably resilient yet rigid material which is responsive to flexing. The inner panel is configured to be installed and replaced with ease.

In still another aspect of the present invention, the replaceable inner panel is formed from an inexpensive material facilitating frequent replacement at low cost.

In still another aspect of the present invention, the inner panel is configured to provide a single section for featuring a single advertisement or a plurality of different sections for featuring a multiplicity of advertisements, each constructed to be individually replaced.

In yet another aspect of the present invention, the inner panel provides a translucent white material to diffuse light for proper illumination and color definition which eliminates the step for providing a final white coat during the silk screening process.

In still another aspect of the present invention, the inner panel facilitates automatic processing and handling which increases the production rate and decreases the cost.

These as well as other features of the invention will become apparent from the detailed description which follows, considered together with the appended drawings.

BRIEF DESCRIPTION OF THE DRAWINGS

A preferred embodiment of the present invention is illustrated in and by the following drawings in which like reference numerals indicate like parts and in which.

DETAILED DESCRIPTION OF THE PREFERRED EMBODIMENT

Vending machines and the like typically comprise a cabinet-like housing which has a compartment therein for storing a selection of food and/or drink items. Upon receiving a designated amount of money, the vending machine dispenses a desired food or drink item to a user.

Figure 1:
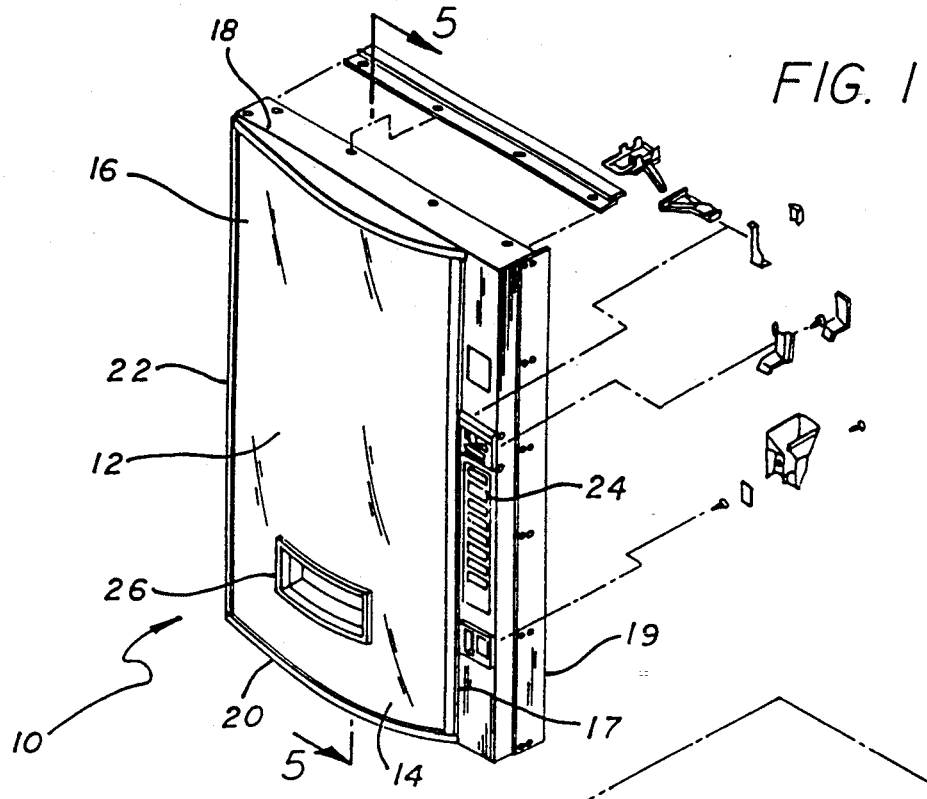
FIG. 1 is a perspective view of a front door of a vending machine, partially exploded in sections, showing a front panel of the replaceable sign face of the present invention.
Figure 2:
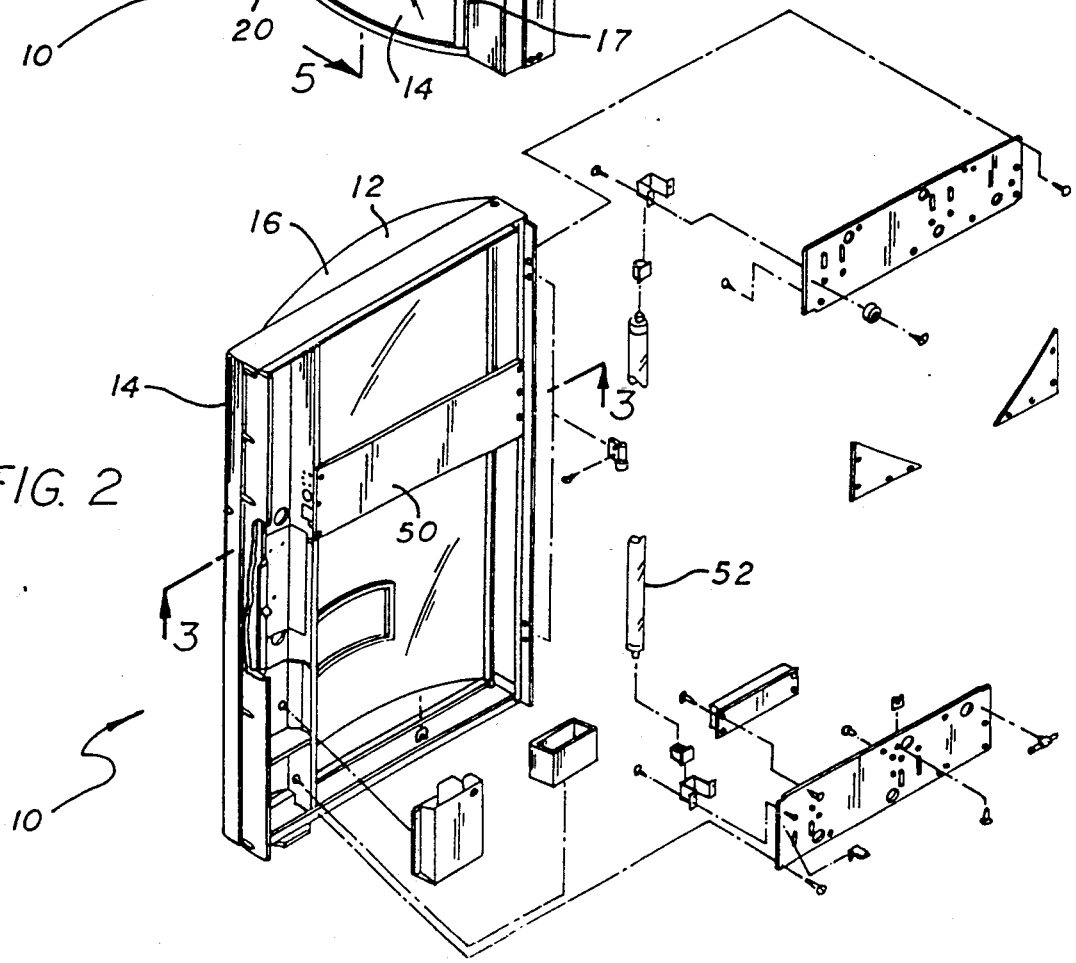
FIG. 2 is another perspective view of the front door shown in FIG. 1, partially exploded in sections, showing an inner panel of the replaceable sign face as installed.

FIGS. 1 and 2 illustrate generally an outer door 10 of an exemplary vending machine. A sign face 12 of the present invention is generally viewed on a front face 14 of the outer door 10. The sign face 12 comprises a front panel 16. The front panel 16 is disposed in an opening 17 provided in the outer door 14.

In the illustrated embodiment, the front panel 16 extends from substantially an upper end 18 of the outer door 10 to a lower end 20 and from a side 22 to a control panel 24. Centrally disposed in the lower half of the front panel 16 is an opening 26 which provides access within a compartment 19 located behind the front door 10, where items of food or drink are stored.

In contrast to prior systems, the front panel 16 in accordance with the presently preferred embodiment of the present invention is transparent and has a generally curved surface. The front panel 16 serves as a permanent protective cover and is formed from a sturdy, tough, solid material such as a suitable polymeric material in order to deter tampering.

Figure 3:
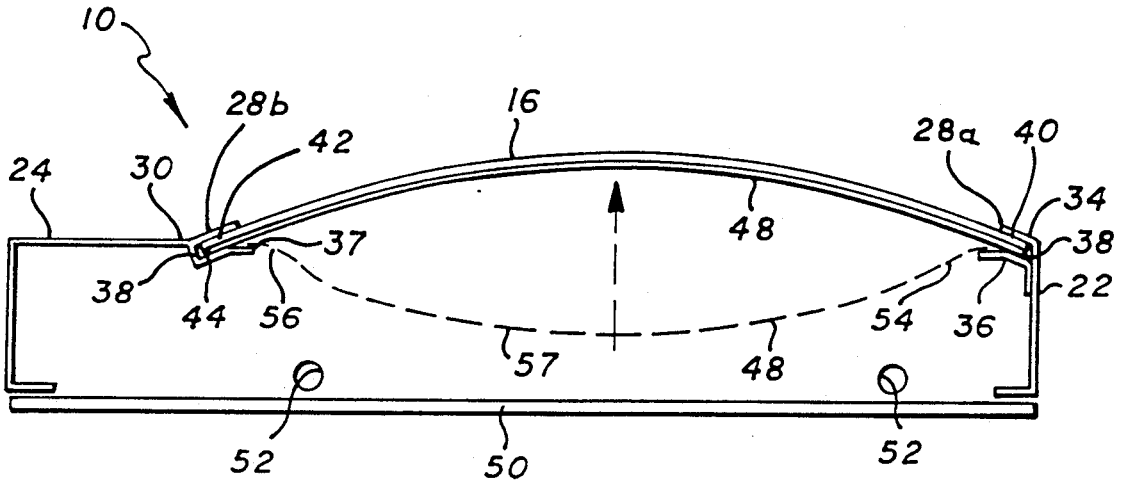
FIG. 3 is a cross sectional view taken along line 3—3 of FIG. 2, showing the replaceable inner panel installed proximate the transparent front panel in solid lines, and the replaceable inner panel prior to being snapped in position, in broken lines.

The front panel 16 is received and held within side retainers 28*a* and 28*b*, respectively, disposed at side 22 of the outer door and an inner edge 30 of the control panel 24, respectively (FIG. 3). The side retainers 28*a* and 28*b* may be of a type currently used in vending machines. Each of the side retainers 28*a* and 28*b* has projecting walls 34 and 36, respectively, which extend in parallel alignment, forming a deep cavity 38 therebetween. The inner projecting wall 36 terminates in a flange 37. The projecting walls 34 and 36 extend at a suitable angle from the horizontal plane. Ends 40 and 42 of the curved front panel 16 are received within the side retainers 28*a* and 28*b* such that preferably a portion 44 of each, intimately contacts the inner periphery of the projecting walls 34 and 36.

Figure 5:
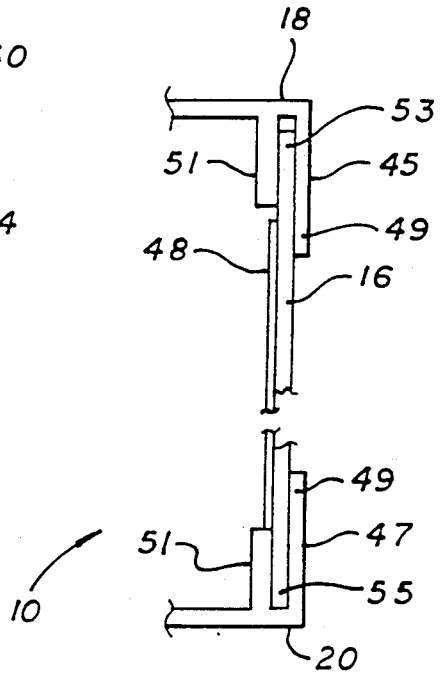
FIG. 5 is a cross sectional view taken along line 5—5 of FIG. 1.

Referring to FIG. 5, the outer door 10 has an upper retainer 45 disposed along its upper end 18 and a lower retainer 47 disposed along its lower end 20. The upper and lower retainers 45 and 47 are substantially identical and have an outer flange 49 and an inner flange 51 extending perpendicularly outward from the upper and lower ends 18 and 20, respectively. The front panel 16 is suitably received within the retainers 45 and 47. An upper edge 53 and a lower edge 55 of the front panel 16 is retained securely between the outer flange 49 and inner flange 51 of the upper and lower retainers 45 and 47. The upper and lower edges 53 and 55 terminate proximate the upper and lower ends 18 and 20, respectively, such that each contacts an inner periphery of the upper and lower ends 18 and 20 or is spaced therefrom by a predetermined amount.

Referring now to FIG. 3, an inner panel 48 bearing a visual display (advertising media, product identification, operating instructions and the like) is inserted within the retainers 28*a* and 28*b* in a manner described below. The visual display (shown generally at 59 in FIG. 1) is provided on the inner panel 48 by any suitable technique known in the field. In a preferred embodiment, the advertising media is silk screened on an inner surface of the inner panel 48.

The inner panel 48 is preferably made from a thin, lightweight, resilient material which is easily flexed without breaking. In a preferred embodiment, the inner panel 48 is formed from a sheet of suitable polymeric material which is relatively inexpensive. Because the inner panel 48 is thin, lightweight and flexible, the silk screening process may be automatically carried out which facilitates an increased production rate at lower cost. The thin translucent material of the inner panel 48 provides proper color illumination and color definition. Providing the visual display on the inner panel 48 avoids the high cost of discarding expensive panels bearing visual displays if scratched during manufacture and assembly.

Referring again to FIG. 5, the inner panel 48 is suitably sized such that it has a height which extends substantially between the upper and lower retainers 45 and 47. The inner panel 48 is not retained within the upper and lower retainers 45 and 47 to facilitate ease of assembly or replacement in a short period of time. The inner panel 48 is retained in position by the side retainers 28*a* and 28*b* as described below. The inner panel 48 has a width which is greater than that of the door opening 17. The inner panel 48 is easily installed from the rear of the door.

One vertical edge 54 is guided into one of the retainers 28*a* or 28*b*. For explanation purposes, a right edge 54 is guided into a right retainer 28*a*. A left edge 56 is slid into the left retainer 28*b* in a similar fashion. Because the width of the inner panel 48 is greater than the distance between the retainers 28*a* and 28*b* (the door opening 17), the resiliency of the material causes a central portion 57 of the inner panel 48 to bow outward in a direction away from the front panel 16, as clearly shown in phantom in FIG. 3. Both the edges 54 and 56 of the inner panel 48 are inserted within the retainers 28*a* and 28*b*. By applying pressure to the inner panel 48 in a direction indicated by the arrow 58, it easily snaps into position proximate the front panel 16. The edges 54 and 56 are guided into the cavity 38 by the projecting walls 34 and 36 of each retainer 28*a* and 28*b* and are securely held therebetween. The replaceable inner panel 48 is held in intimate contact with the front panel 16 by the retainers 28*a* and 28*b*. Alternatively, the inner panel 48 may be spaced from the front panel 16 by an appropriate amount. In an exemplary embodiment, the inner panel 48 is spaced from the front panel 16 by ½ an inch or 1 inch. By spacing the inner panel 48 from the front panel 16, a visual display of a more permanent nature may be screened on the front panel 16 and changing visual displays may screened on the inner panel 48 to create a three dimensional effect.

The replaceable inner panel 48 is easily removed by unscrewing the rear panel 50 and the light source 52 and exerting sufficient pressure to cause the edges 54 and 56 to slide out from within the retainers 28*a* and 28*b* and assume its original, flat, sheet-like configuration.

Figure 4:
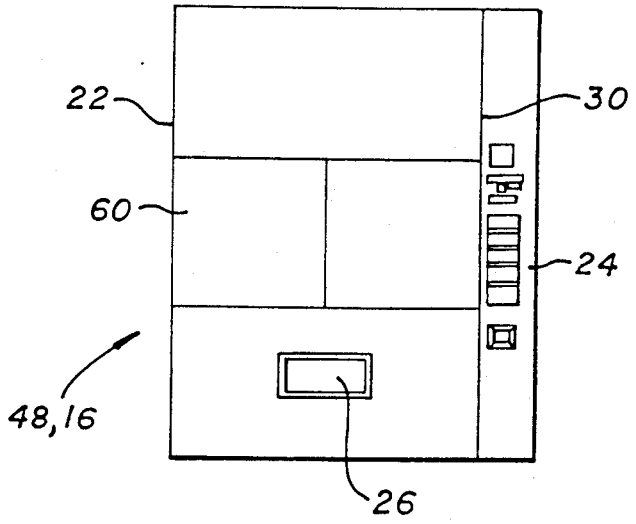
FIG. 4 is a front elevational view of the front door shown in FIG. 1 showing a configuration of the replaceable inner panel having a plurality of different sections featuring separate visual displays.

In such an arrangement, the front panel 16 serves only as a permanent protective cover for the replaceable inner panel 48, which bears the advertising media or visual display. Advantageously, the replaceable inner panel 48 is easily installed, replaced or removed with minimum effort at the vending machine site or the place of manufacture. The inner panel 48 may be configured to provide a single section as shown in FIG. 1 for displaying a single visual display. Alternatively, the inner panel 48 may be configured to provide a plurality of adjoining sections 60 joined in any suitable fashion known in the art to display a plurality of visual displays as shown in FIG. 4. Each of the sections 60 may be individually replaced. It will also be recognized by those skilled in the art that only selected portions of the outer panel 16 may be transparent to expose selected ones of the visual displays as desired for any particular application.

Although the invention has been described in terms of a preferred embodiment thereof, other embodiments that are apparent to those of ordinary skill in the art are also within the scope of the invention. Accordingly, the scope of the invention is intended to be defined only by reference to the appended claims.

What is claimed is:

1. A vending machine having a dispensing means therein, said vending machine comprising:

an outer door attached to the dispensing means, said outer door having an opening defined therein, said opening having a predetermined width and retaining means disposed at first and seconds ends thereof;

a rigid front protective panel formed from a tough, sturdy polymeric material having a transparent section, said front panel being mounted within said retaining means, said front panel providing a sturdy permanent cover; and a replaceable flexible and resilient inner panel having a width greater than said predetermined width of said opening and bearing a visual display, said inner panel being mounted within said retaining means directly behind said front panel, said inner panel configured to be easily inserted into said retaining means in a position bowed away from said front panel and snapped into a position adjacent said front panel upon application of pressure.

2. A vending machine as defined in claim 1, further comprising:

a fluorescent light source located proximate said inner panel, said light source illuminating said visual display.

3. A vending machine as defined in claim 1, wherein said replaceable inner panel is formed from a white and translucent material, said white and translucent material properly diffusing light and providing proper illumination and color definition.

4. A vending machine as defined in claim 1, wherein said inner panel has a single section displaying a single visual display.

5. A vending machine as defined in claim 1, wherein said inner panel has a plurality of sections displaying a plurality of separate visual displays.

6. A vending machine as defined in claim 1, wherein said front panel has a curved surface.

7. A vending machine as defined in claim 1, wherein said replaceable inner panel intimately contacts said front panel in an installed position.

8. A vending machine as defined in claim 1, wherein said replaceable inner panel is spaced from said front panel by a predetermined amount in an installed position.

* * * * *